US006858568B2

(12) United States Patent
Ojima et al.

(10) Patent No.: US 6,858,568 B2
(45) Date of Patent: Feb. 22, 2005

(54) METAL LUBRICANTS CONTAINING A BRIDGE COMPLEX

(75) Inventors: Heijiro Ojima, Karlya (JP); Fumio Kawahara, Toyota (JP); Mitsuru Tomono, Toyota (JP)

(73) Assignee: MEC International Corporation, Aichi (JP)

( * ) Notice: Subject to any disclaimer, the term of this patent is extended or adjusted under 35 U.S.C. 154(b) by 342 days.

(21) Appl. No.: 09/990,857

(22) Filed: Nov. 15, 2001

(65) Prior Publication Data

US 2002/0123435 A1 Sep. 5, 2002

(30) Foreign Application Priority Data

Dec. 21, 2000 (JP) ..... 2000-389433

(51) Int. Cl.[7] ..... C10M 173/02; C07F 3/06

(52) U.S. Cl. ..... 508/363; 508/371; 508/381; 556/14; 556/17; 556/24; 556/38; 556/130; 556/131

(58) Field of Search ..... 508/363, 371, 508/381; 556/14, 17

(56) References Cited

U.S. PATENT DOCUMENTS

| | | | | |
|---|---|---|---|---|
| 3,004,056 | A | 10/1961 | Nunn et al. | 260/461 |
| 3,004,057 | A | 10/1961 | Nunn et al. | 260/461 |
| 3,249,538 | A | 5/1966 | Freier et al. | 252/1 |
| 3,829,506 | A | 8/1974 | Schmolka et al. | 260/615 |
| 3,833,502 | A | 9/1974 | Leary et al. | 252/49.5 |
| 3,933,658 | A | 1/1976 | Beiswanger et al. | 252/31 |
| 3,970,569 | A | 7/1976 | Sturwold et al. | 252/49.3 |
| 4,138,346 | A | 2/1979 | Nassry et al. | 252/32.5 8 |

(List continued on next page.)

FOREIGN PATENT DOCUMENTS

| | | | |
|---|---|---|---|
| DE | 3524629 A1 | 1/1987 | |
| EP | 0 061 823 A1 | 10/1982 | ..... C10M/3/00 |
| EP | 0 398 201 A1 | 11/1990 | ..... C23C/22/12 |
| EP | 0 947 519 A1 | 10/1999 | ..... C07F/3/06 |
| JP | 38-8117 | 6/1963 | |
| JP | 47-45487 | 11/1972 | |
| JP | 50-62207 | 5/1975 | |
| JP | 53-32274 | 3/1978 | |
| JP | 58-063794 | 4/1983 | |
| JP | 61-291591 | 12/1986 | |
| JP | 62-081396 | 4/1987 | |
| JP | 02-305897 | 12/1990 | |
| JP | 04-239096 | 8/1992 | |
| JP | 07-118283 | 5/1995 | |
| JP | 07-118682 | 5/1995 | |
| WO | WO 99/64544 | 12/1999 | |

OTHER PUBLICATIONS

Schey, J.A., "Tribology in Metalworking, Friction, Lubrication and Wear," section 4.7.8 (Phosphate Coatings), pp. 175–178, American Society For Metals, 1983.

*Primary Examiner*—Ellen M. McAvoy
(74) *Attorney, Agent, or Firm*—Perkins Coie LLP

(57) ABSTRACT

Lubricants are taught that can quickly and easily form a lubricating layer on a metal surface of a metal before plastic processing. Such lubricants preferably include a primary lubricating agent or component having a bridge complex that satisfies the following conditions: (1) the complex contains at least two central metal atoms; (2) at least one first multidentate ligand forms a bridge between two central metal atoms; and (3) at least one second multidentate ligand is bound to at least one central metal atom and has at least one coordinating atom that can coordinate with metal atoms, but which is not coordinated with any of the central metal atoms or is only partially coordinated with at least one of those central metal atoms. A third multidentate ligand is preferably also bound to one of the central metal atoms and may preferably include at least two sulfur atoms that are coordinated to the central metal atom.

44 Claims, 4 Drawing Sheets

U.S. PATENT DOCUMENTS

| | | | | |
|---|---|---|---|---|
| 4,151,099 | A | | 4/1979 | Nassry et al. ..... 252/32.7 |
| 4,199,381 | A | | 4/1980 | Nuss et al. ..... 148/6.15 |
| 4,253,975 | A | | 3/1981 | Law et al. ..... 252/32.7 |
| 4,289,547 | A | | 9/1981 | King et al. ..... 148/6.15 |
| 4,654,155 | A | | 3/1987 | Kipp et al. ..... 252/32.5 |
| 4,831,171 | A | | 5/1989 | Bergfeld et al. ..... 556/134 |
| 5,124,308 | A | | 6/1992 | Albin et al. ..... 503/217 |
| 5,385,954 | A | | 1/1995 | Palazzotto et al. |
| 5,716,913 | A | | 2/1998 | Yamamoto et al. ..... 508/365 |
| 5,824,627 | A | * | 10/1998 | McConnachie et al. ..... 508/363 |
| 5,830,577 | A | * | 11/1998 | Murayama et al. ..... 428/411.1 |
| 6,211,123 | B1 | * | 4/2001 | Brown et al. ..... 508/363 |
| 6,232,276 | B1 | * | 5/2001 | Stiefel et al. ..... 508/363 |
| 6,500,786 | B1 | * | 12/2002 | Hartley et al. ..... 508/365 |

* cited by examiner

METAL LUBRICANTS CONTAINING A BRIDGE COMPLEX

This application claims priority to Japanese patent application serial No. 2000-389433 filed Dec. 21, 2000, the contents of which are hereby incorporated by reference in its entirety.

BACKGROUND OF THE INVENTION

1. Technical Field

The present invention relates to lubricants suitable for plastic processing of steel and other metal materials.

2. Related Art

European Patent Publication No. 0 947 519 discloses water-based lubricants that contain sulfur as a coordinating atom. Such lubricants preferably comprise a metal chelate compound that is dispersed or suspended in water or another aqueous solution and such lubricants also preferably contain no oil. A lubricating film is formed on a metal surface when the metal chelate compound is applied to the metal surface. Because the lubricating film contains sulfur as a coordinating atom, sulfur radials may be generated via a tribo-chemical reaction when the metal is subjected to a high pressure, such as the high pressures generated during plastic processing of the metal. The sulfur radials are highly reactive and rapidly form metal sulfides on the metal surface, which provides a lubricating effect when the metal is worked or processed.

SUMMARY OF THE INVENTION

It is, accordingly, one object of the present teachings to teach improved lubricating compounds.

In one aspect of the present teachings, lubricants are taught that may preferably be utilized for plastic processing of steel or other metals. The effective component of the lubricant may preferably include a bridge complex and the effective component or compound preferably satisfies the following conditions:

(1) at least two central metal atoms or metal ions;

(2) at least one first multidentate chelating ligand that forms a bridge between the at least two central metal atoms; and (3) at least one second multidentate chelating ligand having at least one coordinating atom that can be coordinated with a metal atom, but which coordinating atom is not coordinated with any of the central metal atoms or is only partially coordinated with at least one of those central metal atoms.

Optionally, the effective component or compound also may include a third multidentate chelating ligand that comprises at least two sulfur atoms or at least two oxygen atoms that are coordinated to one of the central metal atoms or ions.

"Partial coordination" of a multidentate ligand with a central metal atom is intended to mean that less than all of a plurality of coordinatable atoms (coordinating atoms) that are contained in the multidentate ligand are actually coordinated with coordination sites of central metal atom. That is, only some of the coordinatable atoms are coordinated with the central metal atom(s). Further, "a central metal atom" is intended to mean any metal ion that can coordinate with a ligand (coordinating atoms). In addition, "ligand" is intended to include any atom, atom aggregate, molecule, or ions that are coordinated with a central metal atom in a complex. Moreover, the terms "multidentate" and "polydentate" are intended to include chelating agents or chelating ligands having at least two groups (e.g., atoms) that are capable of attachment (binding or coordination) with a metal atom. The terms "polynucleic," "bidentate" and "dinucleic (binucleic)" are intended to fall within the meanings of multidentate and polydentate unless stated otherwise.

As noted above, the second multidentate ligand preferably includes at least one atom that can be coordinated with various metal atoms, although this at least one atom is not coordinated with a central metal atom in the bridge complex. Therefore, when a lubricant containing such bridge complex as a primary lubricating agent (main component) is applied to a metal surface that will be processed or molded, metal atoms located on the metal surface will form coordinated links or bonds with the bridge complex via the coordinatable atom of the second multidentate ligand. Thus, in a typical example, iron ions, which are usually present on the metal surface in the form of a metal oxide layer, will coordinate with the bridge complex to form a lubricating film.

As a result, the present lubricants can easily attach, coordinate or bond to a metal surface and no special pretreatment, such as degreasing, rust removal, etc., is required before applying the lubricant to the metal surface. Moreover, because chemical bonds are believed to be formed between the metal surface and the bridge complex, the bridge complex strongly binds to the metal surface.

When the metal is then plastically processed or deformed (e.g., drawing or bending the metal), the attached bridge complex will typically decompose (e.g., by a tribo-chemical reaction), due to the high pressure and friction generated on the metal surface. Therefore, the central metal atoms of the bridge complex and any oxygen atoms present will generate metal oxides that provide a lubricating effect. Such metal oxides provide especially effective lubrication properties for relatively light processing of the metal. Light processing is intended to encompass plastic processing of a metal having a relatively small surface area expansion ratio a, as will be discussed further below.

Moreover, because the primary component of the present lubricants is a bridge complex (i.e., the first multidentate ligand(s) form(s) a bridge between at least two central metal atoms), a relatively large number of metal oxides can be produced per each unit surface area of the processed metal. Therefore, a relatively large number of metal oxides can be produced or generated according to the bridging degree per each complex molecule attached via the coordinated link to the metal surface.

The terms "plastic processing" and "plastic deformation" are intended to mean the permanent deformation of the metal, which arises from the relative displacement of atoms or molecules within the metal. The terms "plastic processing" and "plastic deformation" may be, e.g., interchangeable with the term "metal working." Further, "plastic deformation" may take place due to "plastic flow," in which the metal undergoes a variety of extensive, irreversible deformations after the applied stress reaches a critical value.

Thus, the present teachings provide lubricants comprising a bridge complex that serves as an effective component of the lubricant. The bridge complex may demonstrate a lubricating effect by strongly attaching and coordinating to the metal surface. Generally speaking, no particular pretreatment is required in order to form a chemical coating that, e.g., serves as a primer layer, which provides an advantage over most known lubricants that require the prior application of a phosphate film. In addition, the lubricating layer is formed at a molecular level on the metal surface and is substantially completed by the attachment of such complex. Because the present lubricants contain a metal-bridge complex, oil and/or non-aqueous based solvents are not required or can be minimized, thereby improving the working environment. As a result, the present lubricants can rapidly form an effective lubricating layer for plastic processing in a simple manner and without requiring complex and costly pre-treatment or post-treatment processing.

These aspects and features may be utilized singularly or in combination in order to make improved lubricants, including but not limited to lubricants having bridge complexes. In addition, other objects, features and advantages of the present teachings will be readily understood after reading the following detailed description together with the accompanying drawings and the claims. Of course, the additional features and aspects disclosed herein also may be utilized singularly or in combination with the above-described aspects and features.

DETAILED DESCRIPTION OF THE INVENTION

Figure 1:
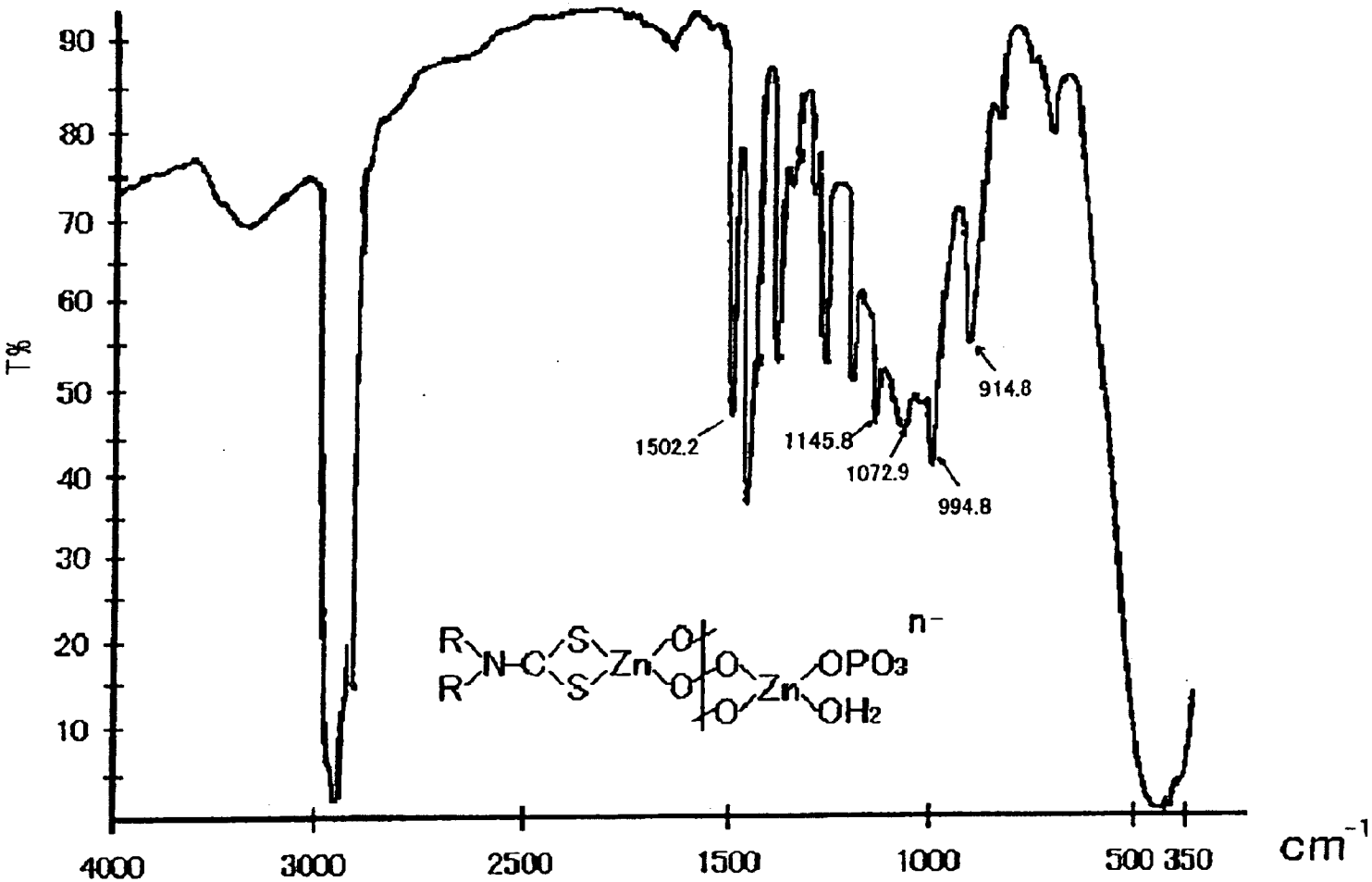
FIG. 1 shows the IR absorption spectra of Formula 35.

Various bridge complexes are taught that may be, e.g., advantageously utilized as the main component of a lubricant. No specific limitations are placed on the physical state of the present lubricants, as long as the main lubricating agent produces suitable lubricating properties when the lubricant is applied to a metal surface. For example, various lubricating liquids (also referred to as "liquid lubricants") can be prepared, e.g., by dispersing or dissolving one or more of the present bridge complexes in a solvent. Although aqueous lubricating liquids are preferably prepared, suitable lubricants may also be prepared in the form of pastes, suspensions, or powders.

In one embodiment of the present teachings, the bridge complex comprises at least two central metal atoms selected from the group of metal ions consisting of zinc, manganese, iron, molybdenum, tin, antimony, and copper. Zinc is particularly preferred. In another embodiment of the present teachings, at least one of coordinating atoms contained in the first multidentate ligand is oxygen. In another embodiment of the present teachings, the first multidentate ligand is preferably selected from the group consisting of inorganic acids, organic acids and salts thereof, all of which have an oxygen atom derived from a hydroxyl group, carboxyl group, or carbonyl group (including those in which some of the hydrogen atoms are cation substituted) as a coordinating atom. Such bridge complexes readily form metal oxides having useful lubricating properties. For example, such bridge complexes are particularly useful for plastic processing that generates high pressures during light processing. Such bridge complexes preferably decompose during plastic processing, e.g., due to a tribo-chemical reaction, in order to provide a lubricating effect.

In another embodiment of the present teachings, at least one third multidentate ligand is coordinated or bound to one of the at least two central metal atoms and comprises at least one sulfur atom as a coordinating atom. Preferably, the least one sulfur atom is coordinated with at least one of the at least two central metal atoms and more preferably, at least two sulfur atoms of the third multidentate ligand are coordinated with at least one of the at least two central metal atoms. Such bridge complexes will form sulfur radicals, e.g. due to tribo-chemical reactions, when the processed metal is subjected to a high pressure. Because sulfur radicals are highly reactive and rapidly react with the metal surfaces that are newly formed during metal processing, the resulting metal sulfides (e.g., iron sulfide) demonstrate excellent lubricating properties. Further, the sulfur radicals also will react with metal ions derived from central metal atoms that are produced during the decomposition of the bridge complex, thereby producing additional metal sulfides that provide further lubricating properties. Thus, such lubricants provide an effective lubricating layer that will easily and rapidly form on the metal surface and are suitable even for heavy processing or working of the metal.

In another embodiment of the present teachings, the second multidentate ligand preferably includes at least one oxygen atom as the atom that can coordinate with the metal atoms of the metal surface that will be processed and which oxygen atom is not coordinated with any of the central metal atoms. Such bridge complexes will easily form coordinated links between the oxygen atom and the metal atoms present at the metal surface when the lubricant is applied to the metal surface. For example, metal ions, such iron ions, are usually present in the form of an oxide in a metal oxide layer on the metal surface. Therefore, such lubricants will form a metal oxide on a relatively large portion of the metal surface, due to atoms derived from the bridge complex as well as metal ions present on the metal surface.

In another embodiment of the present teachings, the second multidentate ligand is selected from the group consisting of inorganic acids, organic acids, amine compounds, derivatives thereof, or salts thereof, which compounds preferably include a hydroxyl group, carboxyl group, or carbonyl group containing an oxygen atom that can serve as a coordinating atom. Such bridge complexes provide a highly reactive group containing the oxygen atom and the metal atoms present on the metal surface (e.g., a metal oxide layer) and coordinated links can easily form between the oxygen atom and the metal atoms present on the metal surface. Therefore, a metal oxide can be easily and rapidly formed on a relatively large portion of the metal surface that will be processed.

In another embodiment of the present teachings, lubricating liquids are taught that can be made by dissolving or dispersing any of the bridge complexes described herein in a solvent. For example, suitable solvents are preferably low-viscosity and include solvents such as water, alcohols, and other similar solvents. Such lubricating liquids may be preferably used to form the lubricating film on the metal surface before plastic processing of the metal. The lubricating liquids may be applied to the metal surface by coating, immersion or any other appropriate technique that will contact a suitable amount of the primary lubricating agent (e.g., one or more of the above-described bridge complexes) with the surface of a metal material that will be processed.

Such lubricating liquids may also include a surfactant in order to assist in uniformly attaching the bridge complexes to the metal surface.

In a particularly preferred embodiment, the bridge complex according to the present teachings preferably includes a polynucleic complex having at least two central metal atoms. At least one first multidentate ligand forms a bridge between at least two central metal atoms. The bridge complex also preferably includes a second multidentate ligand having at least one atom that is capable of coordinating with metal atoms, but which is preferably not coordinated (or only partially coordinated) with the central metal atoms in the bridge complex. A third multidentate ligand is also preferably coordinated to at least one of the central metal atoms. Thus, one generic, but not limiting, example of a bridge complex according to the present teachings is shown in the following Formula (1):

$$Y_m[(L^1)_x M\{L^2_n M\}_p L^3_z]^\alpha \quad \text{[Formula 1]}$$

Preferably, M represents a central metal atom according to the present teachings and the two Ms may be the same or different from each other. $L^1$ represents a mono-dentate ligand or a multidentate ligand, which may be a third multidentate ligand according to the present teachings. $L^2$ represents a first multidentate ligand according to the present teachings. $L^3$ represents a second multidentate ligand according to the present teachings. X and Z represent an integer from 1 to 4, N represents an integer from 1 to 4 (preferably 1) and p represents an integer from 1 to 9. $\alpha$ represents the valence of the complex (i.e., the combined charge of the metals and ligands within the brackets). In addition, the lubricating liquid containing such bridge complexes may contain an appropriate counter-ion, e.g., Y, wherein m is an integer that is determined according to the respective ion valences of Y and $\alpha$. However, it is noted that bridge complexes according to the present teachings are not limited by Formula 1 and other suitable bridge complexes can be made according to the present teachings, as will be discussed further below.

The central metal atoms M of the bridge complex are preferably metal ions selected from the group consisting of zinc, manganese, iron, molybdenum, tin, antimony, and copper. Zinc (ions) is particularly preferred, because zinc oxides and sulfides that form on the metal surface exhibit especially good lubricating properties. No specific limitation is placed on the number of central metal atoms (that is, the number of nuclei in the bridge complex) contained in the bridge complex. Preferably, two to ten metal nuclei are provided. In order to improve stability of the complex molecule, between two to four nuclei are especially preferred. Further, the coordination number of the central metal atoms is not specifically limited, because the coordination number is determined in accordance with the selected metal atoms and ligands.

The first multidentate ligand(s) $L^2$ preferably coordinate (s) with at least two central metal atoms and can form bridges between the central metal atoms. Preferably, the first multidentate ligands include an oxygen atom and/or a nitrogen atom that serve(s) as coordinating atoms in the bridge complex. In the especially preferred ligands, at least one oxygen atom serves as a coordinating atom in the bridge complex.

Representative, but not limiting, examples of suitable first multidentate ligands $L^2$ include polyphosphoric acids, such as chain polyphosphoric acids (e.g., diphosphoric acid, triphosphoric acid, tetraphosphoric acid, pentaphosphoric acid, and cyclic polymetaphosphoric acids, such as trimetaphosphoric acid, tetrametaphosphoric acid). Further suitable first multidentate ligands include the keto-form or enol-form of oxalacetic acid, the keto-form or enol-form of oxalosuccinic acid, hydroxyacids (e.g., citric acid, tartaric acid, malic acid, and other similar acids), gluconic acid, oxalic acid and other organic acids or inorganic acids, derivatives thereof (e.g., oxalic acid derivatives such as oxalic acid monoamide, oxalic acid diamide), and salts thereof.

Representative first multidentate ligands $L^2$ and typical coordination structures thereof are shown in the following Formulas 2–10. Thus, Formula 2 is a representative example of the coordination structure of a keto-form of oxalacetic acid. Formula 3 is a representative example of the coordination structure of a keto-form of oxalosuccinic acid. Formula 4 is a representative example of the coordination structure of citric acid. Formula 5 is a representative example of the coordination structure of tartaric acid. Formula 6 is a representative example of the coordination structure of malic acid. Formula 7 is a representative example of the coordination structure of oxalic acid. Formula 8 is a representative example of the coordination structure of oxalic acid monoamide. Formula 9 is a representative example of the coordination structure of oxalic acid diamide. Finally, Formula 10 is a representative example of the coordination structure of polyphosphoric acid (n in Formula 10 is preferably an integer from 0 to 3).

[Formula 2]

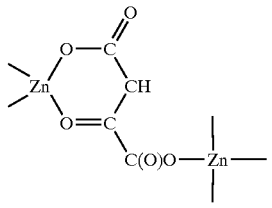

[Formula 3]

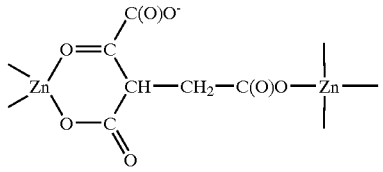

[Formula 4]

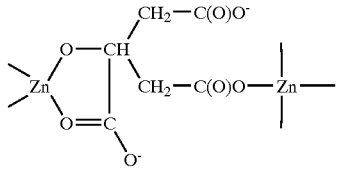

[Formula 5]

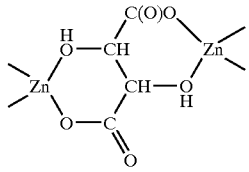

[Formula 6]

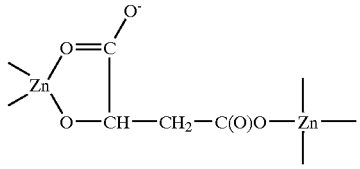

[Formula 7]

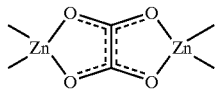

-continued

[Formula 8]

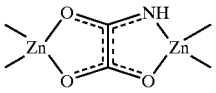

[Formula 9]

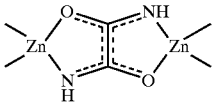

[Formula 10]

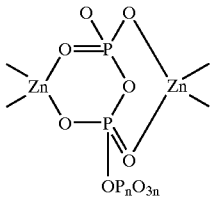

In the above Formulas 2–10, zinc having a coordination number of 4 has been identified as the central metal atom. Naturally, such representations merely exemplify typical coordination structures and place no limitation on the type of central metal atoms and/or the coordination number of central metal atoms. Further, the leftmost zinc atom in Formulas 2–10 may preferably be bound to at least one of a hydroxyl group, an aqua group, a carboxylic acid group, an ester (e.g., —COOR, wherein R is, e.g., a $C_{1-10}$ alkyl group or a benzyl or phenyl group) a dithiocarbamato group (e.g., $S_2(CN)R_1R_2$ or $S_2COR_1$ wherein $R_1$ and $R_2$ are independently $C_{1-12}$ alkyl or $C_{1-12}$ alkenyl or together form an aryl or acyl group) or any of the third multidentate ligands ($L^1$) described herein. In addition, the rightmost zinc atom in Formulas 2–10 may preferably be bound to at least one phosphate group, at least one aqua group, a phosphate group and an aqua group, or any of the second multidentate ligands ($L^3$) described herein.

The second multidentate ligand $L^3$ according to the present teachings preferably includes a group that will cause the bridge complex to attach (bind or coordinate) with the metal surface via a chemical bond. Preferably, at least two coordinating atoms are provided. A coordinating atom may be characterized as an atom provided within the bridge complex (i.e., the complex prior to application to a metal surface) that is not coordinated with any of the central metal atoms. No specific limitation is placed on the molecular structure of the second multidentate ligand, as long as the bridge complex has a coordinating atom that is free to coordinate with metal ions disposed on the metal surface when the bridge complex is applied to the metal surface. Such ligands preferably provide at least one oxygen atom as a coordinating atom, which oxygen can easily coordinate with a metal ion (e.g., an iron ion) present on the metal surface.

Representative, but not limiting, examples of second multidentate ligands $L^3$ include carboxylic acids, amine compounds (amine derivatives), phosphoric acid, oxalic acid, and salts thereof. For example, carboxylates are preferred in which hydrogen in at least some of carboxyl groups of polycarboxylic acids is substituted with cations of alkali metals or other similar groups. Preferably, the second multidentate ligands $L^3$ include at least one functional group (e.g., a hydroxyl group, carboxyl group, or a carbonyl group) that contains an oxygen atom, which can easily and readily react with and bind to metal ions on the metal surface, thereby coordinating the bridge complex to the metal surface.

If the second multidentate ligand $L^3$ is phosphoric acid or oxalic acid, the first multidentate ligand $L^2$ is preferably polyphosphoric acid or oxalic acid, respectively, because in such case the desired coordination structure can be formed easily.

Formulas 11–15 provide additional representative examples of second multidentate ligands $L^3$ according to the present teachings. For example, Formula 11 is a representative example of a polyacrylic acid salt (sodium salt), in which n is preferably an integer from 2 to 200. Formula 12 is a representative example of an alkanolamine, in which R is preferably $C_6H_{11}$ or $C_nH_{2n+1}$ (n is an integer between 1 and 10 and R' is preferably hydrogen or a methyl group). Formula 13 is a representative example of an alkanolamine, in which R is preferably hydrogen or a methyl group and n is an integer between 0 and 8. Formula 14 is a representative example of a phosphoric acid salt, in which M is preferably a monovalent metal that balances the charge of the phosphoric acid ligand and n is an integer between 1 and 4. Finally, Formula 15 is a representative example of an oxalic acid salt, in which M is preferably a monovalent metal that balances the charge of the oxalic acid ligand.

[Formula 11]

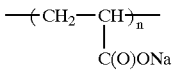

$R—N(C_2H_3R'—OH)_2$ [Formula 12]

[Formula 13]

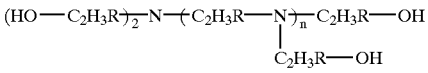

$M_{n+2}P_nO_{3n+1}$ [Formula 14]

$M_2C_2O_4$ [Formula 15]

Other suitable ligands that may be included within the bridge complex in accordance with the present teachings will be described below. For example, ligands other than the above-described first multidentate ligands and second multidentate ligands may be separately and individually coordinated with any of the central metal atoms. In one example, such additional monodentante ligands may include a coordinated water molecule and other similar groups. Further, if at least one central metal atom is an iron ion having a coordination number of 6, the first and second multidentate ligands may be coordinated with four of these coordination sites and other monodentante or bidentate ligands may be coordinated with the remaining two coordination sites. Similarly, if at least one central metal atom is a zinc ion having a coordination number of 4, the first and second multidentate ligand may be coordinated with two of those coordination sites and other monodentante or bidentate ligands may be coordinated with the remaining two coordination sites. As noted above, ligands containing sulfur as a coordinating atom are particularly preferred as the additional ligands.

Additional representative examples of monodentate and bidentate ligands corresponding to the third multidentate ligand $L^1$ shown in the bridge complex of Formula 1 are provided in the following Formulas 16 to 28. In these Formulas, n is preferably an integer between 1 and 10 and R, $R^1$, and $R^2$ are independently $C_{1-12}$ alkyl groups, alkenyl groups, acyl groups, and/or aryl groups. Furthermore, zinc ions (coordination number 4) have been illustrated as a representative central metal atom, a triphosphoric acid ion has been illustrated as a representative first multidentate ligand $L^2$ (this portion is schematically presented in Formula 16; the same is in the following chemical formulas), and a phosphoric acid ion (some include a coordinated water molecule) has been illustrated as a representative second multidentate ligand $L^3$ (a portion thereof is schematically presented in Formula 16; the same is in the following chemical formulas). Further, the negative charge or valance of each of Formulas 16–28 is preferably balanced by one or more positively charged ion(s) (i.e., cation(s)), including but not limited to, alkali metal ions and alkali earth metal ions. However, it should be noted that these formulas merely exemplify typical coordination structures of the bridge complexes in accordance with the present teachings and place no limitation on the types of central metal atoms, coordination numbers (coordination sites) thereof, and the selection/combination of the first and second multidentate ligands according to the present teachings.

[Formula 16]

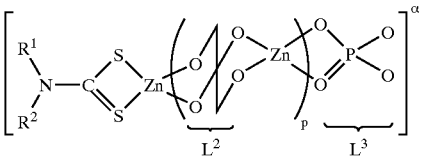

[Formula 17]

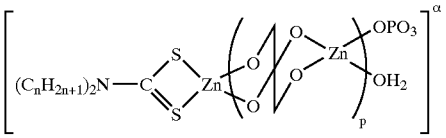

[Formula 18]

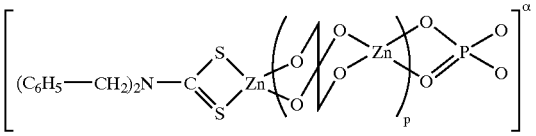

[Formula 19]

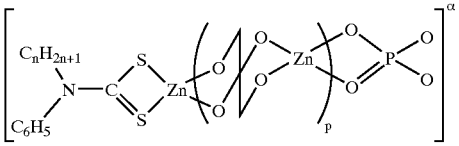

[Formula 20]

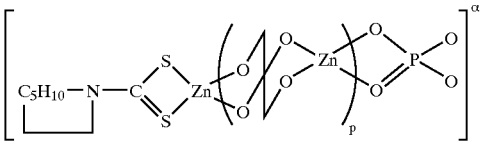

[Formula 21]

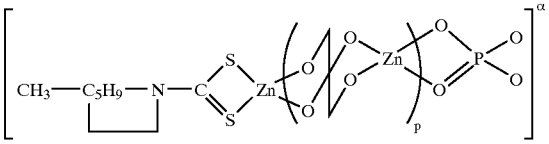

-continued

[Formula 22]

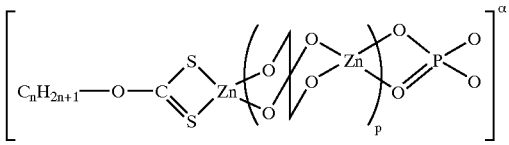

[Formula 23]

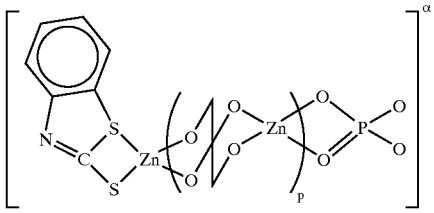

[Formula 24]

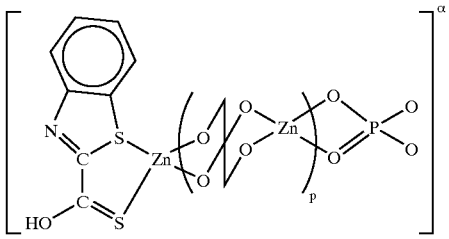

[Formula 25]

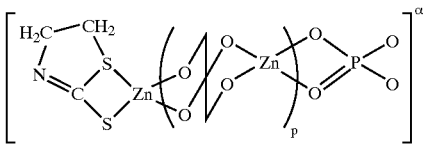

[Formula 26]

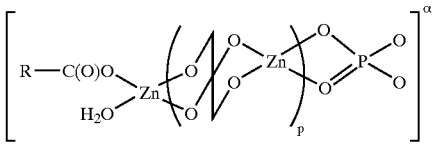

[Formula 27]

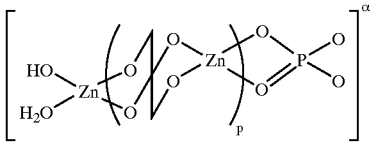

[Formula 28]

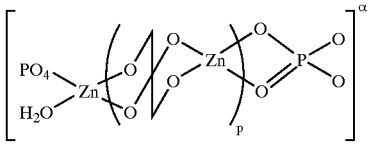

Representative methods for making compounds (bridge complexes) according to the present teachings will now be described. Further, lubricants in accordance with the present teachings can be easily manufactured by appropriately adding, if necessary, various additional components (e.g., anionic surfactants, nonionic surfactants, antioxidants, viscosity-adjusting agents, pH-adjusting agents, anticorrosive agents, antifoaming agents, pigments, perfumes, and the like) to the bridge complex (i.e., the primary lubricating agent) that has been prepared.

Representative examples of anionic surfactants include alkylbenzenesulfonates, alkyl ether sulfates, alkylsulfates, α-olefinsulfonates, saturated or unsaturated fatty acid salts, alkyl or alkenyl ether carboxylates, amino acid-type surfactants, N-acylamino acid-type surfactants, alkyl or alkenyl phosphates, or salts thereof. Representative examples of nonionic surfactants include polyoxyethylene alkyl ethers, polyoxyethylene alkyl phenolates, sorbitan fatty acid esters, sugar fatty acid esters, polyoxyalkylene alkyls, alkenyl ethers, higher fatty acid alkanolamides, alkyl glycosides, alkyl amine oxides and the like.

Thus, in one aspect of the present teachings, bridge complexes can be prepared by mixing a first multidentate ligand $L^2$, a second multidentate ligand $L^3$ (the first multidentate ligand and second multidentate ligand can be the same substance), other ligands (typical examples include the above-described third multidentate ligands $L^1$), and metal ions (which will become the central metal atoms) so as to obtain an appropriate molar ratio of those substances (or mixing compounds, such as salts and the like, that can produce such compounds or can be dissociated thereinto) and employing an appropriate complex-producing means.

For example, a salt containing zinc and/or other metal ions (e.g., a compound that can supply the central metal atoms) may be added to an aqueous solution containing an alkali metal salt (e.g., a compound that can supply the first and second multidentate ligands) of an inorganic acid or organic acid, such as phosphoric acid, polyphosphoric acid, oxalic acid, polyacrylic acid. Thereafter, the mixture is stirred until the reaction is complete. The bridge complex can be produced (e.g., by crystallizing (precipitating) from a solution) by adding to the stirred liquid a compound supplying ligands that are different from the first and second multidentate ligands. For example, a compound may be added that can produce a monodentate ligand or bidentate ligand equivalent to the above-described third multidentate ligand $L^1$. Preferably, such compound can produce "a ligand containing sulfur as a coordinating atom," such as an alkali metal salt of an alkylated dithiocarbamic acid represented by Formula 16 above.

The number of central metal atoms (number of nuclei) in the bridge complex can be adjusted and controlled by appropriately increasing or decreasing the (molar) amount of the compound (that supplies ligands different from the first and second multidentate ligands) with respect to the total amount (molar) of the compound supplying the central metal atom and compound supplying the first multidentate ligand (or first and second multidentate ligands).

For example, when sodium diethyldithiocarbamate (A) is added to a mixture (B) of sodium triphosphate, hydrogen disodium phosphate, and zinc sulfate or a mixture (B') of sodium oxalate and zinc sulfate at a preset molar ratio, a sodium salt of a dinucleic complex represented by the following Formula 29 or Formula 30 (in the formulas, x depends on the pH) is produced and precipitated (see the examples described below).

[Formula 29]

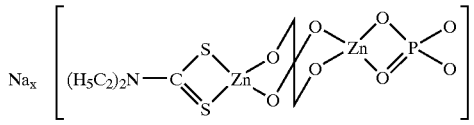

-continued

[Formual 30]

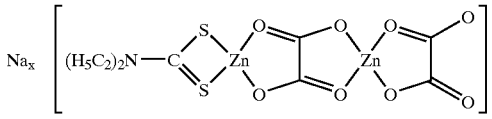

The number of central metal atoms that are coordinated to the first multidentate ligand can be increased by reducing the amount of (A) added to (B) or (B') (molar ratio). As a result, a sodium salt of a trinucleic complex represented by Formula 31 or Formula 32 (in the formulas, x depends on the pH) can be produced and precipitated.

[Formula 31]

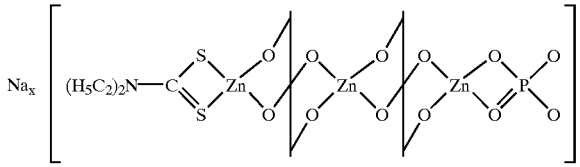

[Formula 32]

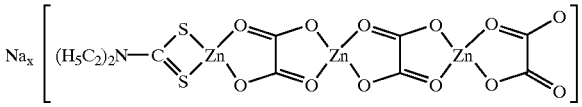

Furthermore, bridge complexes having four, five or more nuclei can be made by further reducing (for example, to about ⅓, ¼ of the preset molar ratio) the amount of (A) added to (B) or (B') (molar ratio).

Moreover, when the lubricant is precipitated, it is not necessary to unify and limit the number of nuclei in the bridge complex contained therein. Therefore, it is possible to mix various types of bridge complexes having different numbers of nuclei in one lubricant, provided that the desired lubricating effect is demonstrated. In other words, when making the present bridge complexes, it is not necessary to set a stringent condition for producing only a pure bridge complex with the same number of nuclei. For example, conditions can be set for producing a mixture that contains about 60% of a dinucleic complex and about 40% of a complex having at least three metal nuclei.

If the bridge complex is hydrophobic, it can be stably dispersed or suspended in water (or another aqueous solution) by adding an anionic or nonionic surfactant to adjust the pH to about 8.0–13.0. Alternatively, the precipitated bridge complex can be physically dispersed (suspended) by forming a fine powder. Such treatment makes it possible to prepare a liquid (aqueous) lubricant containing the hydrophobic bridge complex, substantially without using an oily substance (e.g., an organic solvent).

The present lubricants can be utilized in many ways. For example, as mentioned above, if a bridge complex according to the present teachings serves as the primary lubricating agent, the bridge complex can strongly attach or bond to the surface of a metal that will be processed. If such bridge complexes are utilized, the need to perform a phosphating treatment on the metal surface is eliminated. Thus, a highly adhesive lubricating layer (film) including the bridge complex can be rapidly formed on the metal surface. Therefore, the present lubricants can reduce the time and effort required for lubrication treatment (conversion treatment for plastic processing) prior to plastic processing.

The present lubricants can be directly coated on the metal surface in the form of a solution or a dispersion in an appropriate solvent (aqueous solvents are preferred) or in the form of a powder. No specific limitation is placed on the coating means and commonly utilized methods, such as dipping, brush coating, spray coating, and the like, can be used. For example, a metal material may be subjected to cast surface cleaning by shotblasting or a similar process. That metal material may then be directly (i.e., without special pretreatment) immersed (dipped) into a liquid lubricant containing a suitable amount of the bridge complex. If necessary, various additional components (e.g., an anionic or nonionic surfactant) also can be optionally added. As a result, a lubricating layer or film, comprising the bridge complex, will be bound to the metal surface in a very short time (typically, within 1–2 minutes).

Thereafter, the metal surface (i.e., having the lubricating layer formed thereon) is preferably dried and then the metal can be directly subjected to cold plastic processing, such as punching. Moreover, if the lubricating liquid is applied by means of an immersion bath, the lubricating liquid can be repeatedly re-used upon appropriate replenishment of the main lubricating agent. Therefore, no problems are associated with environmental pollution. Furthermore, because oil based solvents (organic solvent) can be minimized, the danger of oil contamination (oil adhesion or oil mist generation) within the working environment can be avoided or at least minimized.

Each of the additional features and method steps disclosed above and below may be utilized separately or in conjunction with other features and method steps to provide improved lubricants and methods for making and using the same. Detailed representative examples of the present teachings, which examples will be described below, utilize many of these additional features and method steps in conjunction. However, this detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the present teachings in the broadest sense, and are instead taught merely to particularly describe representative and preferred embodiments of the present teachings, which will be explained below in further detail with reference to the figures. Of course, features and steps described in this specification may be combined in ways that are not specifically enumerated in order to obtain other usual and novel embodiments of the present teachings and the present inventors contemplate such additional combinations.

EXAMPLE 1

Synthesis of Sodium $\mu$-triphosphato-orthophosphato-diethylcarbamodithioato dizincate An aqueous solution containing 57.4 g of zinc sulfate (7-hydrate) was added while stirring to a mixed aqueous solution of 36.8 g of sodium triphosphate and 35.8 g of disodium hydrogen phosphate (12-hydrate). As a result, the bridge complexes represented by the following Formulas 33 and 34 crystallized and precipitated from the solution. A suspension of these compounds can be used directly as an aqueous lubricant for light processing.

[Formula 33]

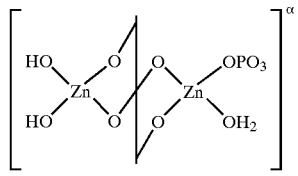

[Formula 34]

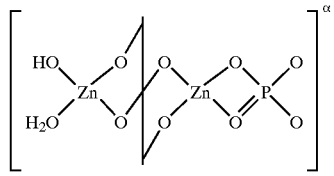

Then, an aqueous solution containing 22.5 g of sodium diethyl dithiocarbamate (3-hydrate) was added dropwise to the suspension while stirring. Upon stirring, the precipitate was filtered to obtain colorless fine crystals (bridge complex) having the structures represented by Formulas 35 and 36 below.

[Formula 35]

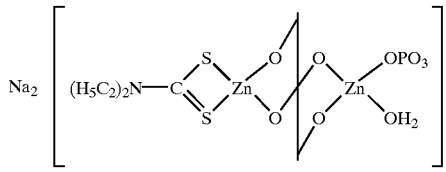

[Formula 36]

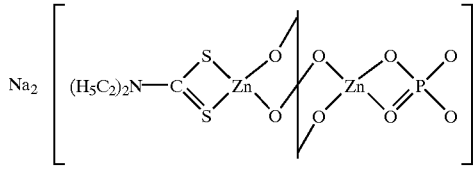

Some of the precipitated crystals were suction dried at a temperature of 110° C., and then further dried. Thereafter, the dry crystals were subjected to chelate titration (EDTA and eriochrome black T were used). As a result, it was determined, based on the chelate titration, that the analytical value (measured value) of the zinc content ratio (Zn %) in the precipitated crystals was 19.11%. This value matches well (relative error is no more than 3%) with the calculated value of 19.25% for $Na_2[Zn_2(C_5H_{10}S_2N)(H_3P_3O_{10})(PO_4)]$.

Structural analysis of the crystals was conducted by IR absorption spectroscopy and is shown in FIG. 1, in which asymmetrical stretching vibrations (indicating a —CSS group contained within the dialkyldithiocarbamic acid ion or the xanthogenic acid ion) was confirmed by a red shift from ~1616 $cm^{-1}$~to~1500 $cm^{-1}$~. This fact indicates that the alkyldithiorabamic acid ion, which contains such a characteristic group (atomic group), is chelated with the metal (zinc) ion. Furthermore, the inherent characteristic absorption bands ~1150 $cm^{-1}$~and~900 $cm^{-1}$~ indicating the presence of ions of diphosphoric acid, triphosphoric acid, and tetraphosphoric acid were observed as specific split absorption bands, thereby indicating that in the present example they coordinated as bridged ligands to zinc ions. Therefore, the results of the IR absorption spectrum and the chelate titration also confirmed that the crystals obtained in the present example include a bridge complex having the structures represented by Formulas 35 and 36 above.

Furthermore, colorless crystals, which included the isolated bridge complexes, were added to a mixed solution consisting of 30 g of sodium stearate and 20 g of nonionic surfactant (polyoxyethylene alkyl ether). Then, sufficient water was added to obtain 1 liter of solution, thereby producing an aqueous lubricant of the present teachings.

EXAMPLE 2

Synthesis of Di-zinc, $\mu$-triphosphato-orthophosphato-dibutyldithiocarbamate

An aqueous solution containing 57.4 g of zinc sulfate (7-hydrate) was added while stirring to a mixed aqueous solution of 36.8 g of sodium triphosphate and 35.8 g of disodium hydrogen phosphate (12-hydrate). As a result, the bridge complexes represented by the following Formulas 33 and 34 crystallized and precipitated from the solution. Then, an aqueous solution containing 22.7 g of sodium dibutyl dithiocarbamate was poured into the suspension while stirring. After further stirring, the precipitate was filtered to obtain colorless fine crystals (bridge complex) having the structures represented by Formulas 37 and 38 below.

[Formula 37]

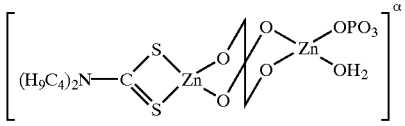

[0091]

[Formula 38]

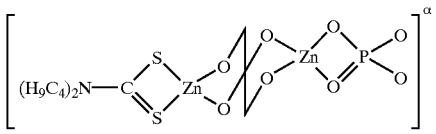

When chelate titration was conducted in the same manner as in the above Example 1, the analytical value (measured value) of the zinc content ratio (Zn %) in the obtained crystals was determined to be 19.45%. This value matches well (relative error is no more than 3%) with the calculated value of 19.00% for $[Zn_2(C_9H_{18}S_2N)(H_3P_3O_{10})(H_2PO_4)]$. When structural analysis was conducted by IR absorption spectroscopy in the same manner as described in the above Example 1, the obtained IR absorption spectra (not shown in the figures) confirmed that the crystals obtained in the present example include a bridge complex having the structures represented by Formulas 37 and 38 above.

Furthermore, colorless crystals, which include the isolated bridge complexes, were added to a mixed solution consisting of 30 g of sodium stearate and 20 g of nonionic surfactant (polyoxyethylene alkyl ether). Then, sufficient water was added to obtain 1 liter of solution, thereby producing another aqueous lubricant of the present teachings.

EXAMPLE 3

Synthesis of Sodium $\mu$-oxalato-diethylcarbamodithioato-oxalato Dizincate

An aqueous solution containing 57.4 g of zinc sulfate (7-hydrate) was added while stirring to an aqueous solution of 26.8 g of sodium oxalate. Then, an aqueous solution containing 22.5 g of sodium diethyl dithiocarbamate (3-hydrate) was added to the solution while stirring. After further stirring, the solvent was evaporated (or the precipitate was filtered) to obtain colorless fine crystals (bridge complex) having the structure represented by Formula 39 below.

[Formula 39]

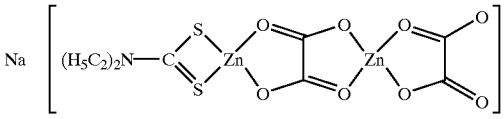

When chelate titration was conducted in the same manner as in the above Example 1, the analytical value (measured value) of zinc content ratio (Zn %) in the obtained crystals was determine to be 27.45%, which value matches well (relative error is no more than 3%) with the calculated value of 27.29% for $Na[Zn_2(C_5H_{10}S_2N)(C_2O_4)_2]$. When structural analysis was conducted by IR absorption spectroscopy in the same manner as described in the above Example 1, the obtained IR absorption spectra (not shown in the figures) confirmed that the crystals obtained in the present example include a bridge complex having the structure represented by Formula 39 above.

Furthermore, colorless crystals, including the isolated bridge complexes, were added to a mixed solution consisting of 30 g of sodium stearate and 20 g of nonionic surfactant (polyoxyethylene alkyl ether). Then, sufficient water was added to obtain 1 liter of solution, thereby producing another aqueous lubricant of the present teachings.

EXAMPLE 4

Synthesis of Sodium $\mu$-triphosphato-diphosphato-2-mercaptobenzothiazole Dizincate An aqueous solution containing 57.4 g of zinc sulfate (7-hydrate) was poured while stirring into a mixed aqueous solution of 36.8 g of sodium triphosphate. Then, an aqueous solution containing 44.6 g of sodium diphosphate (12-hydrate) was added to the solution while stirring. As a result, fine crystals of di-zinc, $\mu$-triphosphato-hydroxo-aqua-diphosphate precipitated. Then, an aqueous solution containing 20.7 g of 2-mercaptobenzothiazole sodium was added to the suspension while stirring. After further stirring, the precipitate was filtered to obtain colorless fine crystals (bridge complex) having the structure represented by Formula 40 below.

[Formula 40]

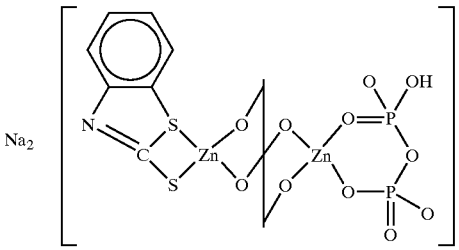

When chelate titration was conducted in the same manner as in the above Example 1, the analytical value (measured value) of zinc content ratio (Zn %) in the obtained crystals was determined to be 17.02%, which value matches well (relative error is no more than 3%) with the calculated value of 16.89% for $Na_2[Zn_2(C_7H_4S_2N)(H_3P_3O_{10})(H_2P_2O_7)]$. Further more, when structural analysis was conducted by IR absorption spectroscopy in the same manner as described in the above Example 1, the obtained IR absorption spectra (not shown in the figures) confirmed that the crystals obtained in the present example include a bridge complex having the structure represented by Formula 40 above.

Furthermore, colorless crystals, which included the isolated bridge complexes, were added to a mixed solution consisting of 30 g of sodium stearate and 20 g of nonionic surfactant polyoxyethylene alkyl ether). Then, sufficient water was added to obtain 1 liter of solution, thereby producing another aqueous lubricant of the present teachings.

EXAMPLE 5

Evaluation of Lubrication Properties (1)

Lubricating properties of the aqueous lubricants manufactured in the above-described examples were evaluated by a common backward punching test, which evaluation will be described below in greater detail.

First, a round, rod-like sample having a diameter of 30 mm and a height of 12–14 mm was prepared from S10C steel (JIS). A punch (made from SKH-51, tip angle 4°, land 4 mm) with a diameter of 21.21 mm, which represents a 50% reduction in cross section area of the sample, was also prepared. Then, the aqueous lubricant (lubricating liquid) obtained in Example 1 was coated on the surface of the sample and the punch, thereby forming a lubricating layer. The punch was dip (immersion) coated in aqueous lubricant prepared according the above described Example 1, so as to produce a coating ratio (adhesion ratio) of 8–12 g/m$^2$, on the surface of punch. Further, the sample was subjected to shotblasting. Upon drying, the sample and punch were subjected to the backward punching test described further below. The coating and drying operations were completed within about 1–2 min.

In Comparative Example 1 of this example, a sample and punch were prepared (coated) with an aqueous lubricant containing a bridge complex represented by Formula 41 below using the same conditions as described above. The sample and the punch were then subjected to the same backward punching test. The shape of the sample and punch and the process for fabrication that were utilized in Comparative Example 1 were the same as those relating to the sample and punch of the present example, except the coated lubricant was different.

[Formula 41]

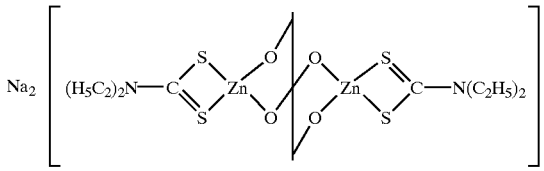

Furthermore, in a separate comparative example (Comparative Example 2), a sample and punch were subjected to a known chemical coating treatment, instead of the coating and drying of the aqueous lubricant of the present example, and then subjected to the backward punching test. Thus, the shotblasted surface of sample and punch was subjected to cleaning, pickling, and neutralization based on known methods, a phosphate film was formed on the surface, and then a metallic soap film was formed thereon. Such treatment required about 30 min to form a lubricating film. The shape of the sample and punch and the process for fabrication thereof that were employed in Comparative Example 2 were the same as those relating to the sample and punch of the present example, except the lubricating coating formation process was different.

Samples obtained in the examples and comparative examples were subjected to plastic processing using the respective punches and a prescribed press (600 ton crank press). Thus, cup-like moldings were shaped by punching the flat surface of the round, rod-like samples that were set into a die (25° C.) and restricted along the perimeter thereof with the respective punches from above the flat surface. The punching depth (i.e., the piercing depth) was gradually increased and the critical depth at which no seizure occurred at the inner surface of the cup in the cup-like moldings was determined to be the maximum piercing depth (mm). The results are shown in the graph of FIG. 2.

Figure 2:
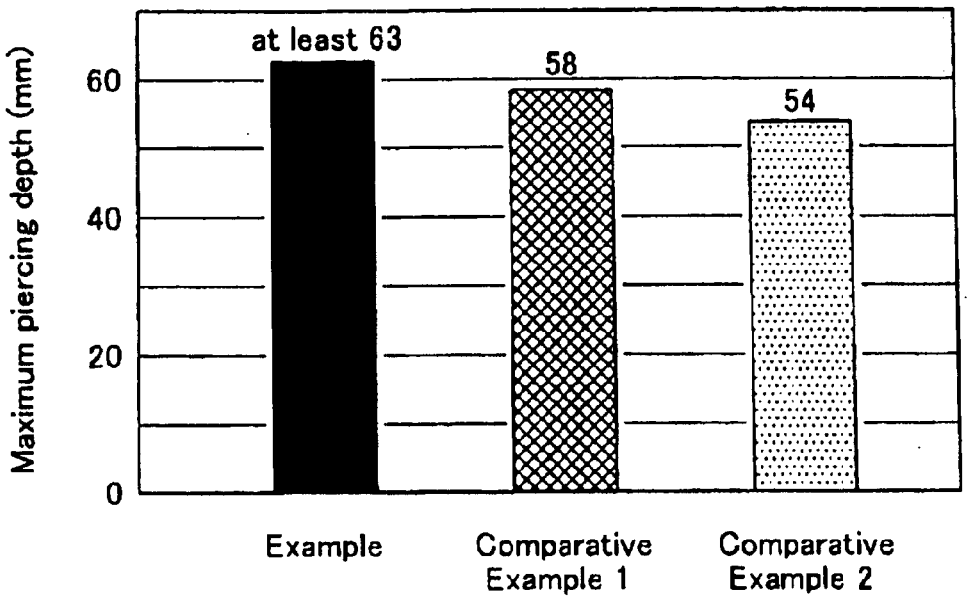
FIG. 2 is a graph illustrating the maximum backward piercing depth in the backward piercing test of Example 5.

The results shown in FIG. 2 demonstrate that the maximum piercing depth was at least 63 mm when a compound (lubricant) prepared according to the present teachings was utilized. This result clearly exceeded the maximum piercing depth of the samples prepared according to the comparative examples. The results also indicate that the present lubricants can provide excellent lubricating properties during plastic processing (heavy processing). Furthermore, such lubricating properties are not limited to the lubricant of Example 1. Thus, substantially the same lubricating properties were also obtained when lubricants of the other examples were used.

While not wishing to be bound by theory, it is believed that the present bridge complexes provide excellent lubricating properties due to the second multidentate ligand (in the examples, orthophosphoric acid ion or polyphosphoric acid ion). The bridge complex can effectively and strongly attach (e.g., chemically bond or coordinate) to the surface of the samples and punches, which result was made clear by comparison with the sample of Comparative Example 1.

EXAMPLE 6

Evaluation of Lubricating Properties (2)

The lubricating properties of the present aqueous lubricants were further evaluated based on the backward piercing test conducted under different conditions. Thus, the backward piercing test was conducted in three modes under conditions ①, ②, ③ shown in Table 1.

TABLE 1

| Conditions | Punch diameter (mm) | Sample: Diameter (mm) | Sample: Total length (mm) | Cross section area reduction ratio (%) |
|---|---|---|---|---|
| ① | 13.1 | 24.6 | 19.0 | 28.2 |
| ② | 17.6 | 24.6 | 15.0 | 50.9 |
| ③ | 22.1 | 24.6 | 9.0 | 80.3 |

Round, rod-like samples having shapes that matched the conditions ①, ②, ③ shown in Table 1 were prepared from steel S12C (JIS). Punches having a diameter (see Table 1) preset so as to obtain a cross section area reduction ratio presented by conditions ①, ②, ③ shown in Table 1 were prepared for the respective samples. Then, lubricating layers were formed using the above-described bridge complex by coating the aqueous lubricant (lubricating liquid) of Example 1 on the surface of the samples in the same manner as in the above Example 1.

In Comparative Example 3, a sample and a punch were coated with an aqueous lubricant of Comparative Example 2 under the same conditions, except an aqueous lubricant according to the present teachings was not used. Further, the shape of the sample and punch and the process for fabrication thereof that were employed in Comparative Example 3 were the same as those relating to the sample and punch of the present example, except the coated lubricant was different.

Moreover, in a separate comparative example (Comparative Example 4), a sample and a punch were subjected to a known chemical (phosphate) coating treatment in the same manner as in Comparative Example 2, instead of coating and drying the aqueous lubricant of the present example. The sample and punch were then subjected to the same backward punching test. The shape of the sample and punch and the process for fabrication thereof that were employed in Comparative Example 4 were the same as those relating to the sample and punch of the present example, except the lubrication layer process was different.

Figure 3:
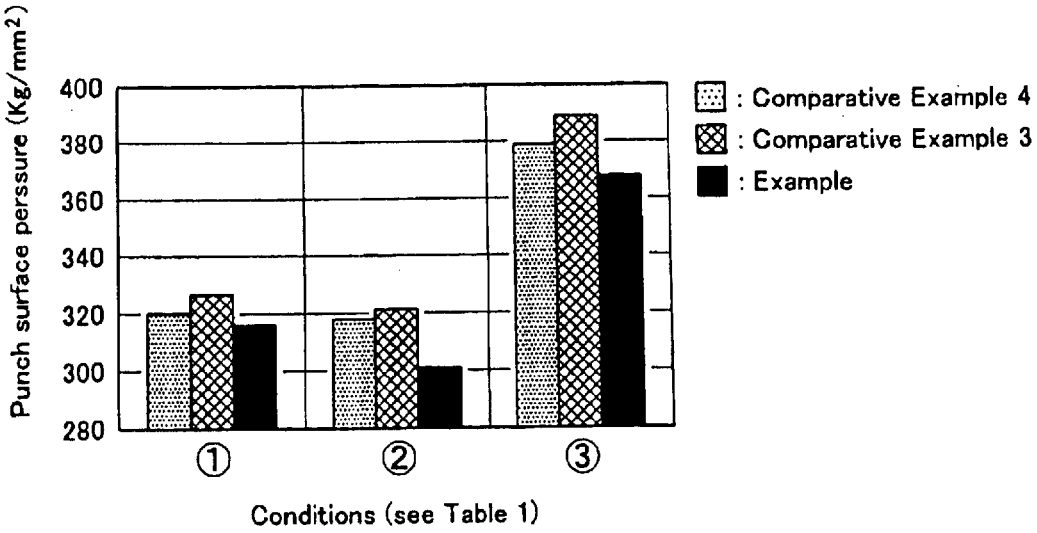
FIG. 3 is a graph illustrating a punch surface pressure in the backward piercing test of an Example 6.
Figure 4:
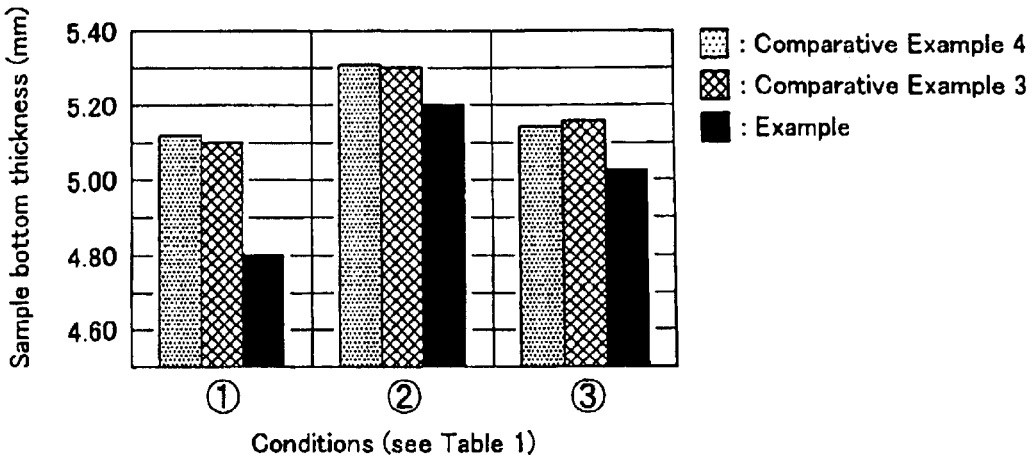
FIG. 4 is a graph illustrating the bottom thickness of the sample in the backward piercing test of Example 6.

The samples of the present example and Comparative Examples 3 and 4 were pierced at a die temperature of 25° C. by using the punches corresponding to conditions ①–② shown in Table 1 and a prescribed press (600 ton crank press). The punch surface pressure and bottom pressure of the sample (an example representing the lubricating properties) were measured. FIGS. 3 and 4 show the measurement results. In FIG. 3, the punch surface pressure of 1 $kg/mm^2$ is equivalent to about $9.8\times10^6$ Pa and in FIG. 4, the bottom thickness is stated in millimeters.

These results clearly demonstrate that the punch surface pressure used for the samples of the present example was lower than the comparative examples for all three conditions ①–③ shown in Table 1. These results indicate that the present lubricants demonstrate excellent lubricating properties during plastic processing (in particular, in light and intermediate processing).

Furthermore, the value of the sample bottom thickness shown in FIG. 4 is assumed to be proportional to the punch recoil value. The figures clearly demonstrate that the value of the bottom thickness obtained when the sample of the present example was employed was less than the comparative examples. This result further indicates that the present lubricant demonstrates excellent lubricating properties during plastic processing (especially during heavy processing). This conclusion is also evident from XPS (ESCA) analysis results (not shown in the figures). Thus, in the backward piercing test of the present example, the amount of produced metal sulfide (typically FeS) was found to be higher at the sample bottom (high-temperature portion) than in other portions.

The above-described examples clearly demonstrate that the present lubricants can quickly and easily form an effective lubricating layer on metal, which lubricating layer will include a bridge complex. Thus, in preferred embodiments of the present teachings, it is not necessary to form a complex chemical film and a phosphate film on the metal before plastic processing, thereby making the plastic processing operation much more efficient.

What is claimed is:

1. A compound having a bridge complex satisfying the following conditions:

(1) at least two central metal atoms;

(2) at least one first multidentate ligand forming a bridge between two central metal atoms; and (3) at least one second multidentate ligand having at least one coordinating atom that can be coordinated with a metal atom, but which is not coordinated or only partially coordinated with the central metal atoms.

2. A compound as in claim 1, wherein the central metal atoms are selected from the group consisting of zinc, manganese, iron, molybdenum, tin, antimony and copper.

3. A compound as in claim 2, wherein the at least one coordinating atom contained in the first multidentate ligand is oxygen.

4. A compound as in claim 3, wherein the first multidentate ligand is selected from the group consisting of an inorganic acid, an organic acid, and salts thereof, and wherein the first multidentate ligand contains an oxygen atom derived from a hydroxyl group, carboxyl group, or carbonyl group, said oxygen atom coordinating with at least one of the central metal atoms.

5. A compound as in claim 4, further including a third multidentate ligand that comprises at least one sulfur atom that is coordinated with at least one of the central metal atoms.

6. A compound as in claim 5, wherein the second multidentate ligand comprises an oxygen atom as the coordinating atom.

7. A compound as in claim 6, wherein the second multidentate ligand is selected from the group consisting of an inorganic acid, an organic acid, an amine compound, derivatives thereof, and salts thereof, wherein the second multidentate ligand contains a hydroxyl group, carboxyl group, or carbonyl group having a coordinating oxygen atom.

8. A compound as in claim 1, wherein the at least one coordinating atom contained in the first multidentate ligand is oxygen.

9. A compound as in claim 1, wherein the first multidentate ligand is selected from the group consisting of an inorganic acid, an organic acid, and salts thereof, and wherein the first multidentate ligand contains an oxygen atom derived from a hydroxyl group, carboxyl group, or carbonyl group, said oxygen atom coordinating with at least one of the central metal atoms.

10. A compound as in claim 1, further including a third multidentate ligand that comprises at least one sulfur atom that is coordinated with at least one of the central metal atoms.

11. A compound as in claim 1, wherein the second multidentate ligand comprises an oxygen atom as the coordinating atom.

12. A compound as in claim 1, wherein the second multidentate ligand is selected from the group consisting of an inorganic acid, an organic acid, an amine compound, derivatives thereof, and salts thereof, wherein the second multidentate ligand contains a hydroxyl group, carboxyl group, or carbonyl group having a coordinating oxygen atom.

13. A lubricating liquid comprising the compound of claim 1 as a main lubricating agent dispersed or suspended in a substantially aqueous solution.

14. A lubricating liquid as in claim 13, further comprising a surfactant.

15. A method of forming a lubricating film on a metal surface comprising contacting the lubricating liquid of claim 14 with the metal surface.

16. A method as in claim 15, wherein the at least two central atoms of the main lubricating agent are zinc.

17. A lubricating liquid comprising the compound of claim 7 as a main lubricating agent dispersed or suspended in a substantially aqueous solution.

18. A lubricating liquid as in claim 17, further comprising a surfactant.

19. A method of forming a lubricating film on a metal surface comprising contacting the lubricating liquid of claim 18 with the metal surface.

20. A method as in claim 19, wherein the at least two central atoms of the main lubricating agent are zinc.

21. A compound as in claim 1 selected from the group consisting of the following formulas 16–34, 37, 38, 40 and salts thereof:

[Formula 16]
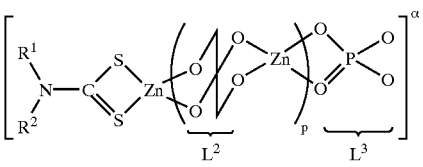
[Formula 17]
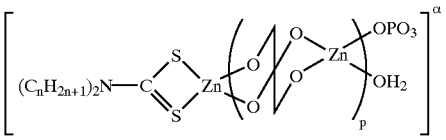
[Formula 18]
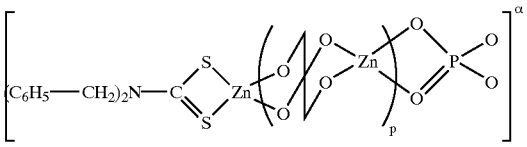
[Formula 19]
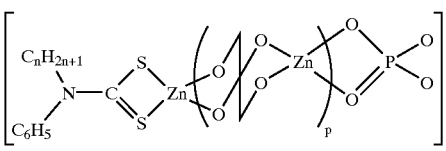
[Formula 20]
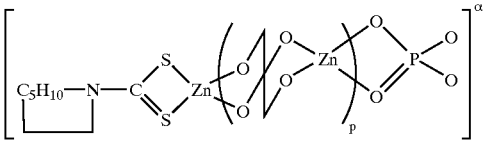
[Formula 21]
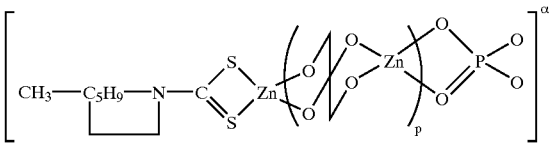
[Formula 22]
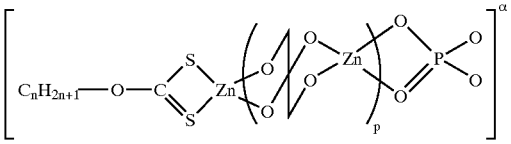
[Formula 23]
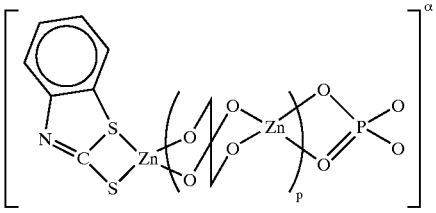
-continued
[Formula 24]
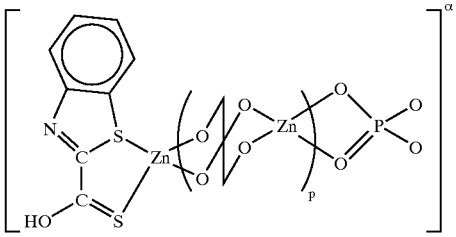
[Formula 25]
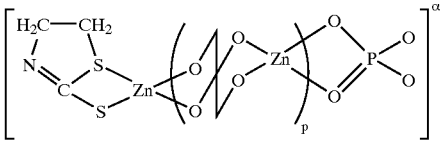
[Formula 26]
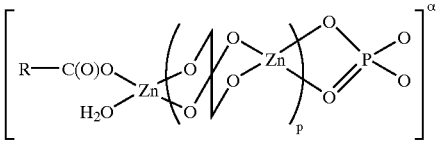
[Formula 27]
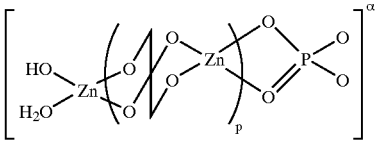
[Formula 28]
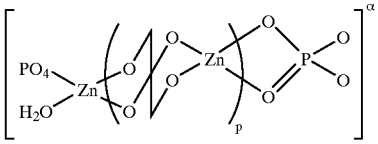
[Formula 29]
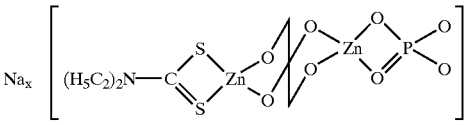
[Formula 30]
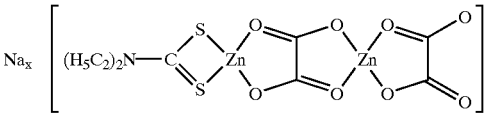
[Formula 31]
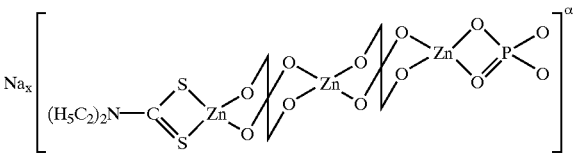
[Formula 32]
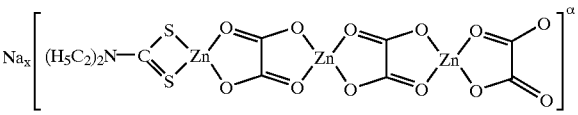

-continued

[Formula 33]

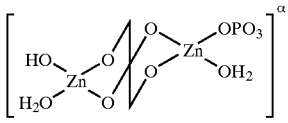

[Formula 34]

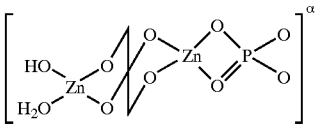

[Formula 37]

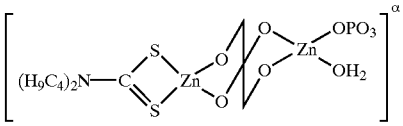

[Formula 38]

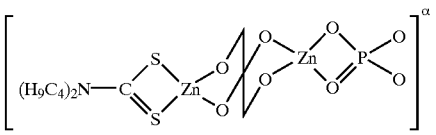

and

[Formula 40]

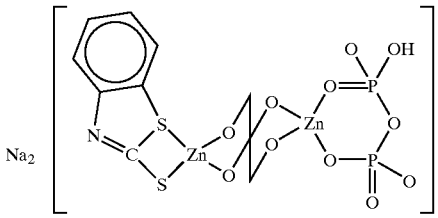

wherein R, $R^1$, and $R^2$ are independently selected from the group consisting of $C_{1-12}$ alkyl groups, alkenyl groups, acyl groups, and aryl groups and x is an integer between 1 and 4.

22. A compound as in claim 21, wherein the compound is negatively charged and the negative charge is balanced by at least one alkali metal ion or at least one alkali earth metal ion.

23. A compound as in claim 22, wherein the compound is selected from the group consisting of formulas 16–20, 22, 23, 25 and 26.

24. A compound as in claim 23, wherein the negative charge of the compound is balanced by at least one sodium ion.

25. A compound as in claim 1, wherein the at least two central metal ions are first and second zinc ions, the first multidentate ligand is a triphosphate group that forms a bridge between the first and second zinc ions, the second multidentate ligand is a phosphate group, in which two oxygen atoms of the phosphate group are bound to the second zinc ion and a third multidentate ligand comprises at least two sulfur atoms or at least two oxygen atoms, in which two sulfur atoms or two oxygen atoms of the third multidentate ligand are bound to the first zinc ion.

26. A compound as in claim 25, wherein the third multidentate ligand is a dithiocarbamato group.

27. A compound as in claim 25, wherein the third multidentate ligand is selected from the group consisting of dimethyl dithiocarbamato, diethyl dithiocarbamato, dipropyl dithiocarbamato, dibutyl dithiocarbamato, methyl benzyl dithiocarbamato, ethyl benzyl dithiocarbamato, propyl benzyl dithiocarbamato, butyl benzyl dithiocarbamato, dibenzyl dithiocarbamato, methyl phenyl dithiocarbamato, ethyl phenyl dithiocarbamato, propyl phenyl dithiocarbamato, butyl phenyl dithiocarbamato, di phenyl dithiocarbamato, cyclopentamethylene dithiocarbamato, ethylxanthogenato, 2-mercaptothiazolinato, 2-mercaptobenzothiazolato and stearao-aqua.

28. A compound having the formula:

$$Y_m[(A)_xM(B_nM)_pC_z]^q$$

wherein:

Y is selected from the group consisting of alkali metal ions and alkali earth metal ions;

M is selected from the group consisting of zinc, manganese, iron, molybdenum, tin, antimony, and copper;

A is selected from the group consisting of dimethyl dithiocarbamato, diethyl dithiocarbamato, dipropyl dithiocarbamato, dibutyl dithiocarbamato, methyl benzyl dithiocarbamato, ethyl benzyl dithiocarbamato, propyl benzyl dithiocarbamato, butyl benzyl dithiocarbamato, dibenzyl dithiocarbamato, methyl phenyl dithiocarbamato, ethyl phenyl dithiocarbamato, propyl phenyl dithiocarbamato, butyl phenyl dithiocarbamato, diphenyl dithiocarbamato, cyclopentamethylene dithiocarbamato, ethylxanthogenato, 2-mercaptothiazolinato, 2-mercaptobenzothiazolato and stearao-aqua;

B is selected from the group consisting of polyphosphoric acids, keto-form or enol-form of oxalacetic acid, keto-form or enol-form of oxalosuccinic acid, a hydroxyacid, gluconic acid, oxalic acid, derivatives and salts thereof;

C is selected from the group consisting of carboxylic acids, alkanolamines, amine derivatives, phosphoric acid, oxalic acid, polycarboxylic acids in which at least one hydrogen in at least one of the carboxyl groups is substituted an alkali metal cation and salts thereof;

n is an integer between 1 and 4;

x is an integer between 1 and 4;

p is an integer between 1 and 9;

z is an integer between 1 and 4;

q represents the valence of the bridge complex and m is an integer between 0 and q, if Y is a single charged ion, m is an integer between 0 and q/2 if Y is a double charged ion and m is an integer between 0 and q/3 if Y is a triple charged ion.

29. A compound as in claim 28, wherein M is zinc.

30. A compound as in claim 29, wherein p is 1 and B is a tripolyphosphato group.

31. A compound as in claim 30, wherein C is a phosphato group.

32. A compound as in claim 31, wherein A is selected from the group consisting of diethyl dithiocarbamato, dibutyl dithiocarbamato, dibenzyl dithiocarbamato, ethyl phenyl dithiocarbamato, cyclopentamethylene dithiocarbamato, ethylxanthogenato, 2-mercaptothiazolinato, 2-mercaptobenzothiazolato and stearao-aqua.

33. A compound as in claim 31, wherein A is selected from the group consisting of diethyl dithiocarbamato, dibutyl dithiocarbamato, dibenzyl dithiocarbamato, ethyl phenyl dithiocarbamato, cyclopentamethylene dithiocarbamato, ethylxanthogenato, 2-mercaptothiazolinato and 2-mercaptobenzothiazolato.

34. A compound as in claim 28, wherein the compound is selected from the group consisting of sodium phosphato-diethyldithiocarbamato-$\mu$-tripolyphosphato dizincate, sodium phosphato-aqua-diethyldithiocarbamato-$\mu$-tripolyphosphato dizincate, sodium phosphato-dibenzyldithiocarbamato-$\mu$-tripolyphosphato dizincate, sodium phosphato-N-ethyl-N-phenyl-dithiocarbamato-$\mu$-tripolyphosphato dizincate, sodium phosphato-cyclopentamethylene-dithiocarbamato-$\mu$-tripolyphosphato dizincate, sodium phosphato-ethylxanthogenato-$\mu$-tripolyphosphato dizincate, sodium phosphato-2-mercaptobenzothiazolato-$\mu$-tripolyphosphato dizincate, sodium phosphato-2-mercaptothiazolinato-$\mu$-tripolyphosphato dizincate and sodium phosphato-stearato-aqua-$\mu$-tripolyphosphato dizincate.

35. A lubricating liquid comprising the compound of claim 34 as a main lubricating agent dispersed or suspended in a substantially aqueous solution.

36. A lubricating liquid as in claim 35, further comprising a surfactant.

37. A method of forming a lubricating film on a metal surface comprising contacting the lubricating liquid of claim 36 with the metal surface.

38. A lubricating liquid comprising the compound of claim 28 as a main lubricating agent dispersed or suspended in a substantially aqueous solution.

39. A lubricating liquid as in claim 38, further comprising a surfactant.

40. A method of forming a lubricating film on a metal surface comprising contacting the lubricating liquid of claim 39 with the metal surface.

41. A method as in claim 40, wherein M is zinc.

42. A compound selected from the group consisting of Formulas 2–10 and salts thereof:

[Formula 2]

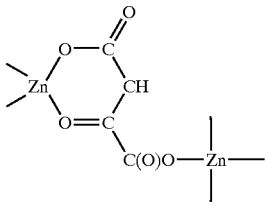

[Formula 3]

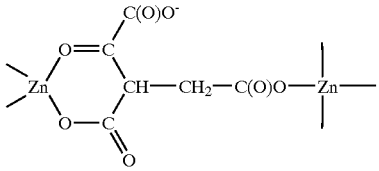

[Formula 4]

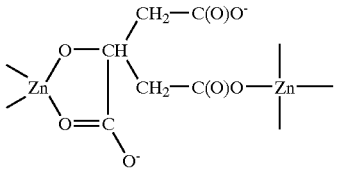

-continued

[Formula 5]

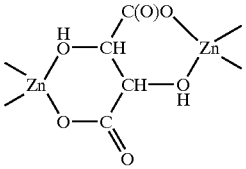

[Formula 6]

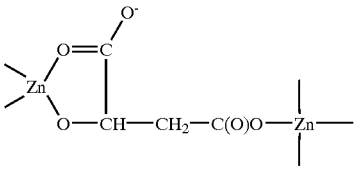

[Formula 7]

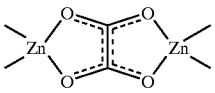

[Formula 8]

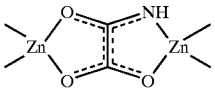

[Formula 9]

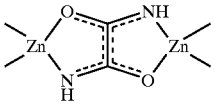

[Formula 10]

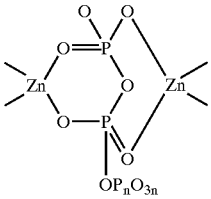

wherein the leftmost zinc atom in Formulas 2–10 is bound to a hydroxyl group, an aqua group, a carboxylic acid group, an ester or a dithiocarbamato group and the rightmost zinc atom in Formulas 2–10 is bound to at least one phosphate group, at least one aqua group or a phosphate group and an aqua group.

43. A compound as in claim 42, wherein the ester is —COOR and wherein R is a $C_{1-10}$ alkyl group or a benzyl or phenyl group.

44. A compound as in claim 43, wherein the dithiocarbomato group is $S_2(CN)R_1R_2$ or $S_2COR_1$ and wherein $R_1$ and $R_2$ are independently $C_{1-12}$ alkyl or $C_{1-12}$ alkenyl or together form an aryl or acyl group.

* * * * *